US010995497B1

(12) United States Patent
Horne

(10) Patent No.: US 10,995,497 B1
(45) Date of Patent: May 4, 2021

(54) FURRING AND FLASHING STRIP SYSTEM

(71) Applicant: James P. Horne, Denver, CO (US)

(72) Inventor: James P. Horne, Denver, CO (US)

( * ) Notice: Subject to any disclaimer, the term of this patent is extended or adjusted under 35 U.S.C. 154(b) by 0 days.

(21) Appl. No.: 16/454,985

(22) Filed: Jun. 27, 2019

Related U.S. Application Data

(60) Provisional application No. 62/692,698, filed on Jun. 30, 2018.

(51) Int. Cl.
*E04F 13/08* (2006.01)
*E04D 1/34* (2006.01)
*E04B 1/68* (2006.01)

(52) U.S. Cl.
CPC ..... *E04F 13/0803* (2013.01); *E04B 1/6803* (2013.01); *E04D 1/34* (2013.01)

(58) Field of Classification Search
CPC ..... E04F 13/0803; E04D 1/34; E04B 1/6803
See application file for complete search history.

(56) References Cited

U.S. PATENT DOCUMENTS 4,333,290 A * 6/1982 Koberstein ..... E04B 1/7612 52/309.2
7,104,018 B2 * 9/2006 Romes ..... E04B 1/7608 52/405.1
8,720,141 B2 * 5/2014 Shembekar ..... E04F 13/0801 52/309.8
2004/0128930 A1 * 7/2004 Ohnishi ..... E04F 13/007 52/474

* cited by examiner

*Primary Examiner* — Andrew J Triggs
(74) *Attorney, Agent, or Firm* — Edwin H. Crabtree; Ramon L. Pizarro

(57) ABSTRACT

An insulation furring and flashing strip system adapted for attachment to insulation board, with or without exterior sheathing, exterior siding, metal panels, sheets, roofing, signage or exterior masonry products. The insulated furring and flashing strip system includes insulation foam insulation received inside a "U" shaped, a "Hat" shaped, or a trapezoidal shaped metal channel. The insulation foam is bonded to the metal channel. The metal channel includes dimpled screw holes for receiving elongated strip system screws. The screws are used for securing the strip system to wall and roof stud framing. Building wall or roof siding is then attached to metal channel.

8 Claims, 3 Drawing Sheets

ALIGNED FOAM

ALIGNED FOAM

ALIGNED FOAM

FURRING AND FLASHING STRIP SYSTEM

This non-provisional patent application claims a filing date and the benefit of the subject matter found in a provisional patent application, Ser. No. 62/692,698, having a title of "Furring and Flashing Strip System", by the subject inventor, and filed on Jun. 30, 2018.

BACKGROUND OF THE INVENTION

(a) Field of the Invention

This invention relates to a furring and flashing strip system for exterior finish of a habitable building and construction of similar wall and roof building structures. The strip system allows for simplification of current construction practices, and reduces and/or eliminates problematic issues such as maintaining a continuous insulation envelope. Also the system provides a tight air and water barrier, as required for energy code compliance. Further, the system provides for required thermal performance, and structural support of cladding systems.

Still further, the strip system provides for a robust means for attachment to a siding or sheet roofing product, thin set masonry, and full brick and stone masonry. Yet further, the strip system can be part of a support system for a roofing deck or standing seam metal roof panels, standing seam metal wall panels, signage, solar panels, skylights, and items attached to a building structure. Even further, the system can be utilized in a building interior for support of ceiling systems, interior wall sheeting for increased thermal and acoustical separation, signage, and similar products used in a building interior.

(b) Discussion of Prior Art

Heretofore, there have been a large number of issued patents and published patent applications related to exterior insulation, cladding attachment systems and related products. These documents include U.S. Pat. No. 745,547 to Wight, U.S. Pat. No. 939,749 to Sagendorph, U.S. Pat. No. 1,253,216 to Day, U.S. Pat. No. 1,655,117 to Voight, U.S. Pat. No. 1,714,411 to Walter, U.S. Pat. No. 1,714,457 to Voight, U.S. Pat. No. 1,833,174 to Morris, U.S. Pat. No. 2,309,420 to Taylor, U.S. Pat. No. 2,448,109 to Michael, U.S. Pat. No. 2,551,801 to Huber, U.S. Pat. No. 3,333,379 to Harris, U.S. Pat. No. 3,359,700 to Birum, U.S. Pat. No. 3,421,281 to Harris, U.S. Pat. No. 3,525,189 to Nelsson, U.S. Pat. No. 3,722,166 to McNerney, U.S. Pat. No. 4,408,427 Zilch, U.S. Pat. No. 4,506,484 to Bartlett et al, U.S. Pat. No. 4,885,884 to Schilger, U.S. Pat. No. 5,517,795 to Doke, U.S. Pat. No. 5,758,464 to Hatton, U.S. Pat. No. 6,125,608 to Charlson, U.S. Pat. No. 6,484,465 to Higgins, U.S. Pat. No. 7,043,884 B2 to Moreno, U.S. Pat. No. 7,191,570 B1 to Eaton, 8,033,066 B2 to Griffiths, 8,484,921 B2 to Edkins, 8,621,823 B2 to Mears, 8,833,025 B2 to Krause, 8,910,441 B1 to Hunter et al, 8,973,329 B2 to Milostic et al, 9,109,368 B2 to MacKenzie, 9,140,007 B2 to Beaty et al, 9,243,399 B2 to Kubassek et al, 9,458,624 B2 to Colyn, U.S. Pat. No. 9,540,804 to Farahmandpour, and U.S. Pat. No. 9,803,372 B2 to Griffeths et al.

The following applications are also relevant, some of which have been abandoned: 2009/0084.047 A1 to Williams, 2010/0251647 A1 to Enns, 2010/0037549 A1 to Lynch et al, 2012-0174511 to Harding, 2013-0125487 to Power et al, 2017/0096814 A1 to Ukrainetz, and 2017-0342724 to Farahmandpour.

None of the above mentioned prior art references disclose the unique features, objects and advantages of the subject insulation furring and flashing strip system as disclosed herein.

SUMMARY OF THE INVENTION

A primary object of the subject insulation furring and flashing strip system is to provide a system for exterior and interior finish of a building structure, which allows for simplification of current construction practices, reduces and/or eliminates problematic issues such as maintaining a continuous insulation envelope.

Another object of the furring and flashing strip system is it maintains a tight air and water barrier for improved thermal performance of the building structure.

Still another object of the system is to provide a more robust and improved means for attachment to wall and roof sheet siding, or exterior cladding materials such as brick masonry.

Further, another object of the system is it can be used as a support system for signage, solar panels, skylights, and other such items attached to a building structure.

The subject insulation furring and flashing strip system is adapted for attachment to an insulation board, with or without exterior sheathing and exterior siding. The strip system includes foam insulation received inside a "U" shaped, or a "C" shaped, or a "Hat" shaped, or a trapezoidal shaped metal channel and bonded thereto. The metal channel includes spaced apart, dimpled screw holes for receiving elongated screws for securing the strip system to the structure directly, or a structure behind the insulation board. Exterior siding or other exterior wall or roof products discussed above are then attached to the metal channel. The insulation foam can be flush with sides of the metal channel or projecting outwards from the sides of the metal channel. The projecting insulation foam provides for additional thermal separation from an exterior wall or roof system, or for metal building components such as a prefabricated metal building, or for thermally separate roof panels or wall panels.

These and other objects of the present invention will become apparent to those familiar with various types of insulation furring and flashing systems used in building construction when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the insulation furring and flashing strip system as described herein.

DETAILED DESCRIPTION OF THE PREFERRED EMBODIMENTS

Figure 1A:
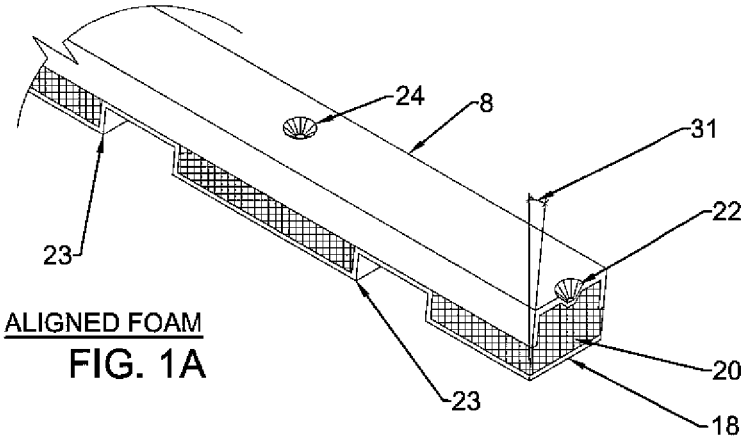
FIG. 1A illustrates a perspective view of the insulation furring and flashing strip system having a metal channel in a trapezoid configuration, with castellated indents of insulation foam received in the channel and extending outwardly from the sides of the metal channel.

In FIG. 1A, a perspective view of the insulation furring and flashing strip system is shown having general reference numeral 8. The strip system 8 is shown in this drawing having castellated indents 23 of insulation foam 20 in a metal channel 22 and having a trapezoid configuration. The castellated indents 23 of the insulation foam 20 extends outwardly from the sides of the metal channel 22. Spaced apart recessed dimpled holes 24 are pre-formed into the metal channel 22 to receive elongated screws 26, shown in FIG. 2. The head of the screws sits flush with an outside face of the channel.

An optional air/water flashing barrier 18 is applied to an underside of the insulation foam 20. The flashing barrier 18 is placed against the building and serves to seal seams of insulation without adding additional flashing. Castellated indentations or grooves 23 are formed into the insulation foam 20 to allow for drainage. The grooves 23 can be formed in various sizes depending on the fabrication process and drainage requirements. At the castellated orientation, sides of the metal channel 22 are skewed slightly outward at angle 31 to allow for moisture or condensation to move or flow away from the exterior siding and flow back and down towards an air barrier and out commonly provided weep holes at a bottom of exterior wall system.

Figure 1B:
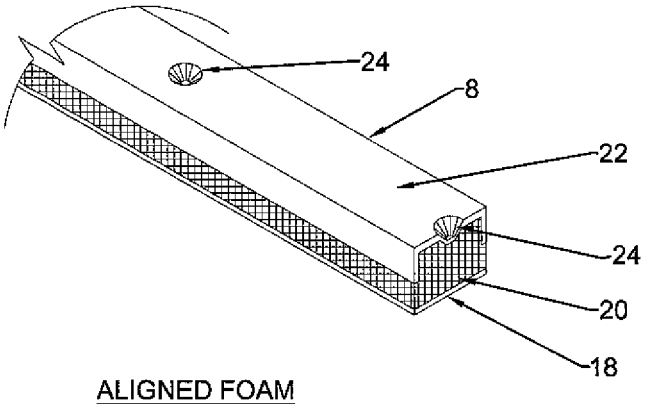
FIG. 1B illustrates a perspective view of the insulation furring and flashing strip system having the metal channel in an inverted "U" shape configuration, with projecting insulation foam extending outwardly from the sides of the metal channel.

In FIG. 1B, a perspective view of the insulation furring and flashing strip system 8 is illustrated with the metal channel 22 in an inverted "U" shape configuration. In this drawing, the projecting insulation foam 20 extends outwardly from the sides of the metal channel.

Figure 1C:
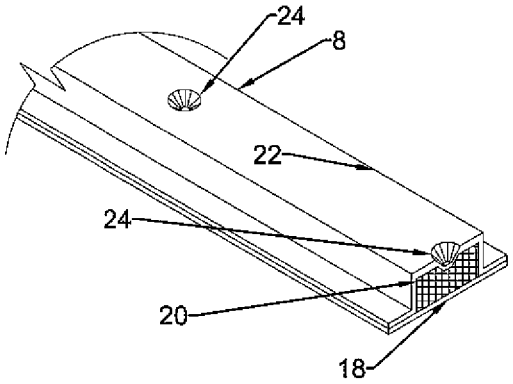
FIG. 1C illustrates a perspective view of the insulation furring and flashing strip system having the metal channel in a "Hat" shaped configuration, with aligned insulation foam next to a bottom of the sides of the metal channel.

In FIG. 1C, a perspective view of the insulation furring and flashing strip system 8 is shown having the metal channel 22 in a "Hat" shaped configuration, with aligned insulation foam 20 extend next to a bottom of the sides of the metal channel.

While the system 8 is shown in FIGS. 1A, 1B and 1C, it is not necessarily limited to these three particular geometries and can include a ribbed or a ridged finish and other configurations. Also the aligned insulation foam, shown in FIG. 1C, and projecting insulation foam, shown in FIG. 1B, are primarily intended for vertical applications, while the castellated insulation foam, shown in FIG. 1A, is intended for horizontal application, to provide a drainage path for any condensation behind wall finishes, that drains away from a finish surface and back towards a water and air barrier of the building.

Figure 2:
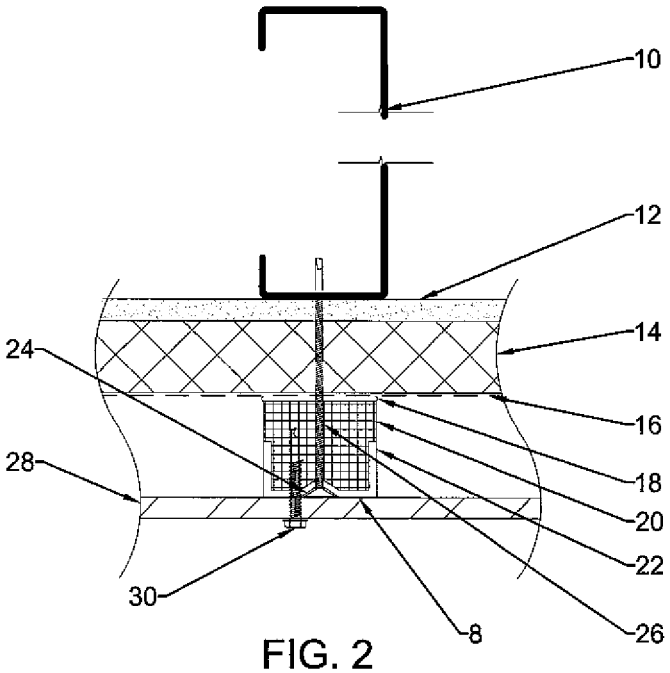
FIG. 2 illustrated a top view of the insulation furring and flashing strip system in a vertical orientation and attached to a vertical building framing stud.

In FIG. 2, the furring and flashing strip system 8 is shown attached to a vertical building framing stud 10. While the stud 10 is shown in this drawing, the strip system can also be used with solid concrete walls, masonry walls, or other structural elements depending on the building structure at a given project. The stud 10 is shown disposed against exterior sheathing 12 and exterior rigid insulation board 14. The exterior sheathing 12 may be omitted and is not a requirement of the subject invention 8.

In this drawing, the elongated screws 26 are used for securing the strip system 8 through the insulation board 14 and attached to the framing stud 10. The flashing barrier 18 is self-sealing, such that screw penetration does not compromise the exterior weather barrier. Exterior wall or roof siding 28 is then attached to the metal channel 22 using short exterior screws 30. The exterior screws 30 do not penetrate the integral flashing barrier 18, maintaining weather protection while providing adequate structural attachment. The screws 30 are staggered along a length of the metal channel 22 with the elongated screws 26 to avoid fastener conflict.

Figure 3:
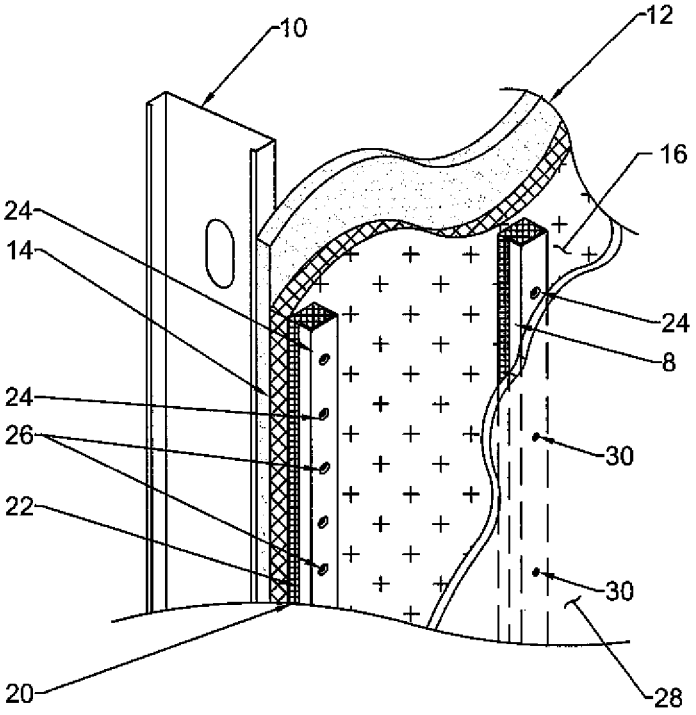
FIG. 3 illustrates a perspective view of the furring and flashing strip system, shown in FIG. 2.

In FIG. 3, a perspective view of the furring and flashing strip system 8 is illustrated, as shown in FIG. 2. In this view, the elongated screws 26 and the exterior screws 30 are shown for alternate receipt in the dimpled holes 24. The exterior screws 30, as mentioned above, are used to secure the wall and roof siding 28 to the metal channels 22. The elongated screws 26 are used to secure the metal channels 22 to the framing stud 10.

Figure 4:
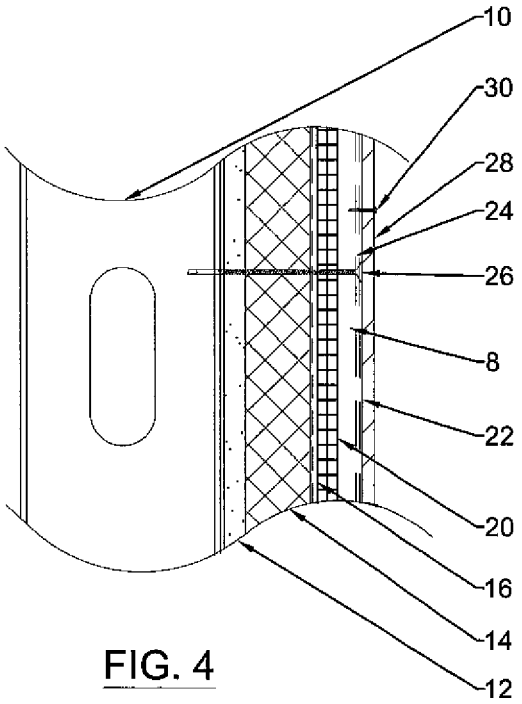
FIG. 4 shows a side sectional view of the furring and flashing strip system, shown in FIG. 3.

In FIG. 4, a side sectional view of the furring and flashing strip system 8 is shown, as illustrated in FIG. 3.

Figure 5:
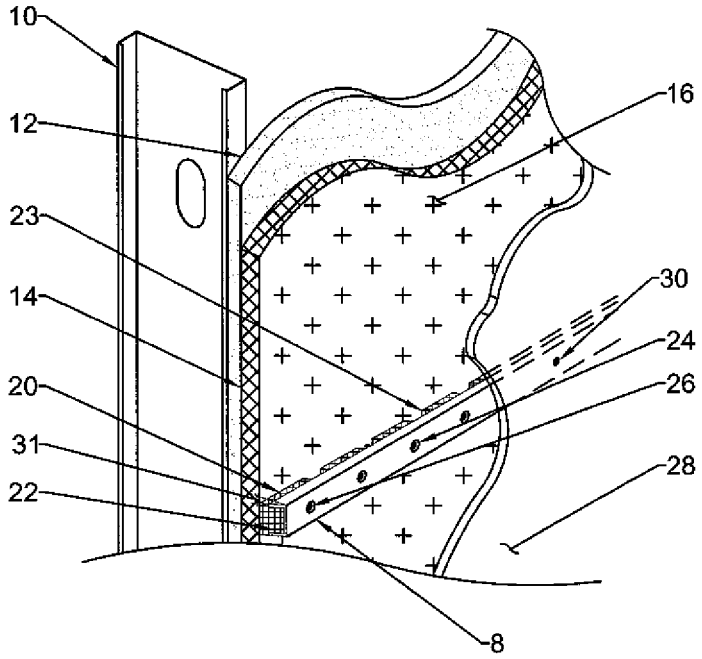
FIG. 5 illustrates the insulation furring and flashing strip system in a horizontal orientation and used with an exterior or roof siding.

In FIG. 5, the insulation furring and flashing strip system 8 is shown in a horizontal orientation and used with the exterior wall or roof siding 28.

Figure 6:
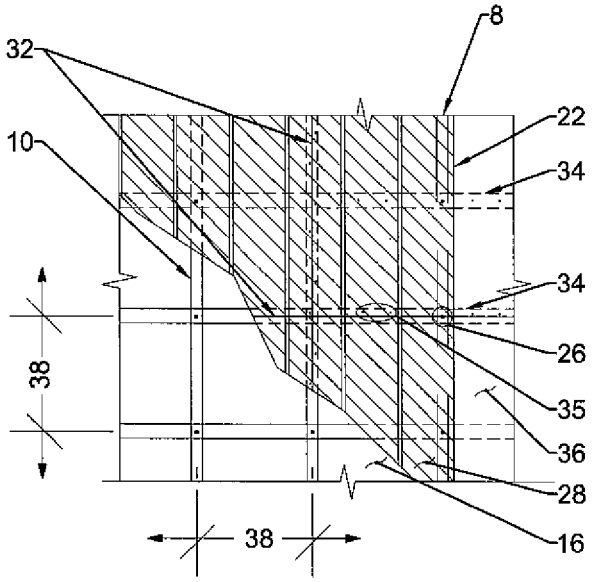
FIG. 6 shows an exterior wall or roof elevation and illustrating an alternate support mechanism for vertically siding or panels and using the vertically oriented insulation furring and flashing strip system.

In FIG. 6, an alternative application for vertically oriented siding or panels is shown, using spaced apart metal strapping 34 fastened to the metal channel 22 with short screws 35, which will penetrate the flashing barrier 18. Exterior siding or sheeting 36 is then attached to both the vertical furring and flashing strip metal channel 22 and the horizontal metal strapping 34, using the screws 35. Exterior siding or sheeting joints 32 are then aligned over the metal strapping 34

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which an exclusive privilege and property right is claimed are defined as follows:

1. An insulation furring and flashing strip system adapted for attachment to an insulation board, the furring and flashing strip system can be used with wall or roof exterior siding, the furring and flashing strip system comprising:

insulation foam;

a metal channel, the insulation foam received in the metal channel and bonded thereto; and an air/water flashing barrier applied on an underside of the insulation foam, the air/water flashing barrier adapted for placing against a building and serves to seal seams of insulation without adding additional flashing on the underside of the insulation foam.

2. The furring and flashing strip system as described in claim 1 wherein the metal channel has a "U" shape configuration.

3. The furring and flashing strip system as described in claim 1 wherein sides of the metal channel are skewed outwardly at an angle for moisture and condensation movement away from the exterior siding and through the furring and flashing strip system.

4. The furring and flashing strip system as described in claim 1 wherein the insulation foam is a projecting foam extending outwardly from side of the metal channel.

5. An insulation furring and flashing strip system adapted for attachment to an insulation board, the furring and flashing system can be used with wall or roof exterior siding, the furring and flashing strip system comprising:

insulation foam;

a metal channel, the insulation foam received in the metal channel and bonded thereto;

an air/water flashing barrier applied on an underside of the insulation foam, the air/water flashing barrier adapted for placing against a building and serves to seal seams of insulation without adding additional flashing on the underside of the insulation foam;

a plurality of spaced apart screw holes along a length of the metal channel, and a plurality of elongated screws received through the screw holes, the screws adapted for securing the insulation board to a building structure.

6. The furring and flashing strip system as described in claim 5 wherein the metal channel has a "U" shape configuration.

7. The furring and flashing strip system as described in claim 5 wherein sides of the metal channel are skewed outwardly at an angle for moisture and condensation movement away from the exterior siding and through the furring and flashing strip system.

8. The furring and flashing strip system as described in claim 5 wherein the insulation foam is a projecting foam extending outwardly from side of the metal channel.

* * * * *